US007430378B2

(12) United States Patent
Inami et al.

(10) Patent No.: US 7,430,378 B2
(45) Date of Patent: Sep. 30, 2008

(54) IMAGE FORMING APPARATUS SETTING AN IMAGE FORMING CONDITION BASED ON CHARACTERISTICS OF A CARTRIDGE, CARTRIDGE USED IN THE IMAGE FORMING APPARATUS, AND STORAGE MEDIUM MOUNTED ON THE CARTRIDGE

(75) Inventors: Satoru Inami, Namazu (JP); Nobuo Komiya, Yokohama (JP); Daisuke Baba, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 11/222,186

(22) Filed: Sep. 8, 2005

(65) Prior Publication Data

US 2006/0056858 A1 Mar. 16, 2006

(30) Foreign Application Priority Data

Sep. 10, 2004 (JP) ..... 2004-264220
Aug. 1, 2005 (JP) ..... 2005-222899

(51) Int. Cl.
*G03G 15/00* (2006.01)

(52) U.S. Cl. ..... 399/12; 399/25; 399/26

(58) Field of Classification Search ..... 399/12, 399/24–26

See application file for complete search history.

(56) References Cited

U.S. PATENT DOCUMENTS 5,272,503 A 12/1993 LeSueur
6,674,975 B2 * 1/2004 Yamauchi ..... 399/12
6,694,106 B2 * 2/2004 Yoshimura ..... 399/12
7,088,928 B2 * 8/2006 Burchette et al. ..... 399/12

FOREIGN PATENT DOCUMENTS

| | | |
|---|---|---|
| JP | 08-146677 | 6/1996 |
| JP | 10-221938 | 8/1998 |
| JP | 10-246994 | 9/1998 |
| JP | 11-015214 | 1/1999 |
| JP | 3285785 | 3/2002 |
| JP | 2003-330335 | 11/2003 |

* cited by examiner

*Primary Examiner*—William J Royer
(74) *Attorney, Agent, or Firm*—Canon U.S.A. I.P. Div

(57) ABSTRACT

An image forming apparatus allows mounting thereon and dismounting therefrom a plurality of types of cartridges, each of the cartridges including a plurality of process members used for image formation and a storage medium for storing information. The image forming apparatus includes a storage unit that stores a plurality of pieces of setting information for setting an image forming condition in accordance with a plurality of characteristics of the cartridges; and a controller that sets the image forming condition based on information regarding a usage amount of each of the plurality of types of cartridges and selection information for selecting one of the plurality of pieces of setting information, the selection information being stored in the storage medium in the cartridge.

19 Claims, 12 Drawing Sheets

(Related Art)

| | 0 | $\alpha_S1$ | $\alpha_S2$ |
|---|---|---|---|
| DRUM USAGE AMOUNT | 0 | 10000 | 100000 |
| NUMBER OF COPIES IN 1-COPY/JOB MODE | 0 | 500 | 5000 |
| DRUM FILM THICKNESS (ESTIMATED) | 30μm | 29.5μm | 25μm |

| | 0 | $\alpha_L1$ | $\alpha_L2$ | $\alpha_L3$ |
|---|---|---|---|---|
| DRUM USAGE AMOUNT | 0 | 20000 | 160000 | 300000 |
| NUMBER OF COPIES IN 1-COPY/JOB MODE | 0 | 1000 | 8000 | 15000 |
| DRUM FILM THICKNESS (ESTIMATED) | 40μm | 39μm | 32μm | 25μm |

IMAGE FORMING APPARATUS SETTING AN IMAGE FORMING CONDITION BASED ON CHARACTERISTICS OF A CARTRIDGE, CARTRIDGE USED IN THE IMAGE FORMING APPARATUS, AND STORAGE MEDIUM MOUNTED ON THE CARTRIDGE

BACKGROUND OF THE INVENTION

1. Field of the Invention

The present invention generally relates to electrophotographic image forming apparatuses, cartridges that can be mounted on main units of the image forming apparatuses, i.e., process cartridges, developing units provided in the form of cartridges, image forming systems, and storage media included in the cartridges.

The electrophotographic image forming apparatuses include, for example, electrophotographic copying machines, electrophotographic printers (e.g., LED printers and laser beam printers), and electrophotographic facsimile machines.

The cartridges that can be mounted on the main units of the electrophotographic apparatuses refer to cartridges including at least one of an electrophotographic photosensitive member, a charging unit for charging an electrophotographic photosensitive member, a developing unit for supplying developer to an electrophotographic photosensitive member, and a cleaning unit for cleaning an electrophotographic photosensitive member. Particularly, a process cartridge refers to a cartridge including an electrophotographic photosensitive member integrated with at least one of a charging unit, a developing unit, and a cleaning unit so that the cartridge can be mounted on and dismounted from a main unit of an electrophotographic image forming apparatus, or a cartridge including an electrophotographic photosensitive member integrated with at least a developing unit so that the cartridge can be mounted on and dismounted from a main unit of an electrophotographic image forming apparatus.

2. Description of the Related Art

In image forming apparatuses that employ electrophotographic image forming processes, the process cartridge system has been used, in which a cartridge including an electrophotographic photosensitive member integrated with process members that act on the electrophotographic photosensitive member can be mounted on and dismounted from a main unit of an image forming apparatus. According to the process cartridge system, maintenance of the apparatus can be performed by a user without calling a service person. This considerably improves convenience of operation. Thus, the process cartridge system is widely used in electrophotographic image forming apparatuses.

Furthermore, according to some proposed techniques, a memory is provided as a storage unit in a process cartridge (hereinafter simply referred to as a cartridge) to store information regarding the cartridge in the memory. For example, according to techniques proposed in Japanese Patent Laid-Open No. 10-221938, the manufacturing lot or the type of cartridge, the type of developer (toner), and so forth are stored in a memory in order to manage the quality of the cartridge.

Furthermore, techniques for achieving stable image quality irrespective of the usage status of a cartridge using information stored in a memory provided in the cartridge have also been proposed. For example, in an image forming apparatus disclosed in U.S. Pat. No. 5,272,503, the number of copies printed (or copied) accumulated as the usage amount of a cartridge in a main unit of the image forming apparatus is recorded in a memory at appropriate timing, and process conditions (image forming conditions) are controlled according to the accumulated value of the number of copies.

Various other techniques for achieving stable image quality have been proposed, for example, in Japanese Patent Laid-Open No. 08-146677, Japanese Patent Laid-Open No. 10-246994, and Japanese Patent Laid-Open No. 11-015214.

In image forming apparatuses disclosed in Japanese Patent Laid-Open No. 08-146677, Japanese Patent Laid-Open No. 10-246994, and Japanese Patent Laid-Open No. 11-015214, a charging bias applied to a charging unit and a developing bias applied to a developing unit are changed in accordance with reduction in the thickness of the photosensitive layer of a photosensitive drum due to use of the cartridge, so that change in image quality due to change in the thickness of the photosensitive layer of the photosensitive drum is reduced.

Furthermore, in order to calculate the degree of usage of a photosensitive drum more precisely, for example, according to techniques disclosed in Japanese Patent No. 3285785, rotation-time information of a photosensitive drum and application-time information of a charging bias applied to a charging unit for charging the photosensitive drum are accumulated and stored in a memory provided in a cartridge, and the amount of usage of the photosensitive drum is calculated precisely using these pieces of information.

Recently, in accordance with the spread of computers, an increasing variety of users has come to use printers, copying machines, facsimile machines, and so forth, and manufacturers now have to produce their products in view of this situation.

Under this situation, as for process cartridges as expendable parts for printers, copying machines, facsimile machines, and so forth, in some cases, different types of process cartridges that can be mounted on the main unit of the same image forming apparatus, having different toner capacities (life spans), are provided. For example, cartridges having larger toner capacities and longer life spans are provided to users who print in large volumes, such as users whose use image forming apparatuses at offices or the like, and cartridges having smaller toner capacities are provided to users who print in small volumes or who prefer inexpensive cartridges, such as personal users of image forming apparatuses.

In the cartridges that have different toner capacities (life spans) and that can be mounted on the main unit of the same image forming apparatus, the configurations of the cartridges are suitably chosen in accordance with their respective toner capacities (life spans). Thus, usually, the thicknesses of the photosensitive layers of photosensitive drums differ between the cartridges as well as the toner capacities. In this case, even when the cartridges are used for the same number of copies or the same period of time, latent-image characteristics (charging characteristics) and development characteristics change differently between the cartridges in relation to the cartridge usage amount. Due to the difference in latent-image characteristics and development characteristics, it has been difficult to achieve stable image quality through correction in all the cartridges having different toner capacities (life spans) with the above-described techniques alone).

For example, using an S cartridge having a shorter life span (a smaller toner capacity) and an L cartridge having a longer life span (a larger toner capacity), process control (setting for switching process conditions in accordance with the drum usage amount herein) suitable for the L cartridge was exercised similarly for the S cartridge irrespective of cartridge type. Comparison between the densities of images obtained with the S cartridge and the L cartridge demonstrated a density difference of 0.05 to 0.1 at halftone densities with a print ratio of 25%, as shown in FIG. 15. That is, images of different qualities were obtained due to the difference in cartridge type between the S cartridge and the L cartridge used in the same image forming apparatus.

This indicates that even when the same image is printed, a density difference could occur due to difference between the types of cartridges used.

SUMMARY OF THE INVENTION

The present invention is directed to an image forming apparatus that is capable of forming images with stable image quality even when a plurality of types of cartridges is used.

The present invention is also directed to an apparatus, a cartridge, and a storage medium with which, even when images are formed using a plurality of types of cartridges having different toner capacities or different thicknesses of photosensitive layers of photosensitive drums, it is possible to reduce variations in image quality due to difference in characteristics of the plurality of types of cartridges based on process-condition setting information stored in storage media provided in the respective cartridges, thereby forming images with stable image quality.

According to one aspect of the present invention, an image forming apparatus having a plurality of types of cartridges detachably mountable thereto, each cartridge including a plurality of process members used for image formation and a storage medium storing information, is provided. The image forming apparatus includes a storage unit storing pieces of setting information used for setting an image forming condition in accordance with characteristics of the cartridges; and a controller setting the image forming condition based on information regarding a usage amount of each cartridge and selection information for selecting one of the pieces of setting information, the selection information being stored in the storage medium in the cartridge.

According to another aspect of the present invention, a cartridge detachably mountable to an image forming apparatus is provided. The cartridge includes an image carrier; a plurality of process members that acts on the image carrier; and a storage medium including a storage area storing selection information for selecting one of pieces of setting information for setting an image forming condition in accordance with characteristics of the cartridge.

According to yet another aspect of the present invention, a storage medium that is mounted on a cartridge used in an image forming apparatus, the cartridge including an image carrier and a plurality of process members that acts on the image carrier, is provided. The storage medium includes a storage area storing selection information for selecting one of a plurality of pieces of setting information for setting an image forming condition in accordance with a plurality of characteristics of the cartridge. According to yet still another aspect of the present invention, an image forming apparatus having a plurality of types of cartridges detachably mountable thereto, each cartridge including a plurality of process members used for image formation, the image forming apparatus including: a storage unit that stores pieces of setting information in accordance with characteristics of the cartridges; and a controller that sets image forming condition based on the pieces of setting information stored in the storage unit.

Further features of the present invention will become apparent from the following description of exemplary embodiments with reference to the attached drawings.

DESCRIPTION OF THE EMBODIMENTS

Now, an image forming apparatus and a cartridge according to embodiments of the present invention will be described in detail with reference to the drawings.

Figure 1:
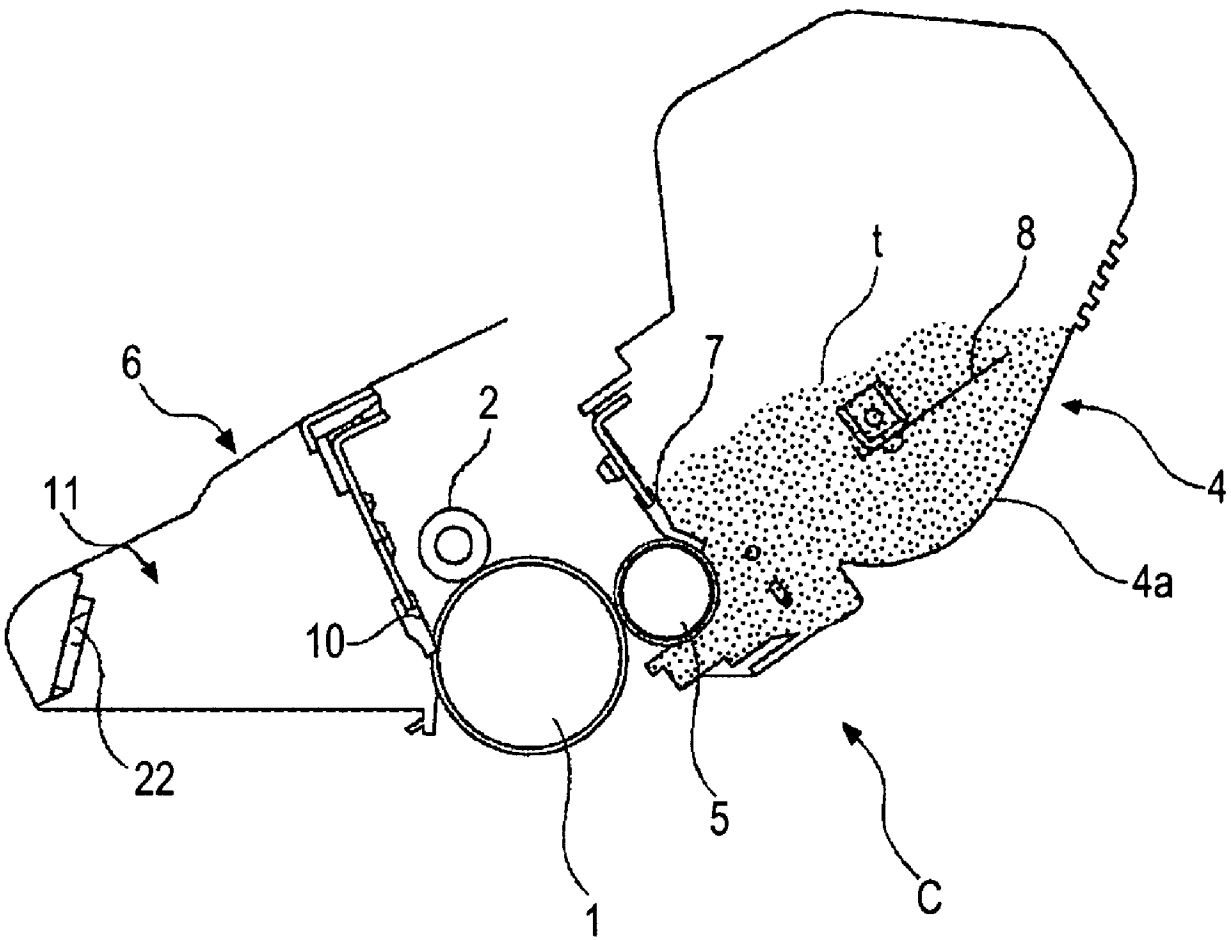
FIG. 1 is a sectional view of a process cartridge according to an embodiment of the present invention.

First, with reference to FIGS. 1 and 2, an electrophotographic image forming apparatus according to an embodiment of the present invention, which allows a cartridge according to an embodiment of the present invention to be mounted thereon and dismounted therefrom, will be described. The image forming apparatus according to the embodiment is a laser beam printer that receives image information from a host computer and outputs an image. The electrophotographic image forming apparatus allows exchanging of a process cartridge by mounting it thereon and dismounting it therefrom. The process cartridge includes integrated components, for example, a photosensitive drum as an electrophotographic photosensitive member, other process units, and expendable items, such as toner as developer.

In this embodiment, a process cartridge C includes integrated components, namely, a photosensitive drum 1, a contact charging roller 2 for uniformly charging the photosensitive drum 1, a developing unit 4 including a developing roller 5 (hereinafter referred to as a developing sleeve 5) that is disposed opposing the photosensitive drum 1 and including a toner container 4*a* that is connected to the developing sleeve 5 and that serves as a developer container for containing toner t, and a cleaning unit 6 including a cleaning blade 10 and a waste-toner container 11 for collecting toner removed from the photosensitive drum 1 by the cleaning blade 10.

The charging roller 2 has a conductive elastic member formed on the surface of a metal core. The ends of the metal core are rotatably held. The charging roller 2 is urged on the outer surface of the photosensitive drum 1 by a predetermined urging force so that the charging roller 2 rotates in accordance with the rotation of the photosensitive drum 1. The charging roller 2 receives application of a superposed voltage (Vac+Vdc) composed of an AC component Vac and a DC component Vdc, having a peak-to-peak voltage Vpp that is twice as large as or even larger than an initial charging voltage, so that the outer surface of the rotating photosensitive drum 1 in contact with the charging roller 2 is uniformly charged by AC voltage application.

The developing sleeve 5 is a non-magnetic aluminum sleeve (roller) coated with a resin layer. Although not shown, a four-pole magnetic roll is disposed in the developing sleeve 5. The toner t carried on the developing sleeve 5 is regulated to an appropriate amount by a developer regulator 7.

The toner t contained in the toner container 4*a* is magnetic single-component toner that gets charged negatively.

The developing sleeve 5 receives a developing bias, for example, a superposed voltage composed of a DC voltage and a rectangular-wave AC voltage.

Furthermore, the toner container 4*a* includes a toner stirring member 8, which stirs and thereby softens toner in the toner container 4*a* before the toner is forwarded to a developing region in the proximity of the developing sleeve 5.

Figure 2:
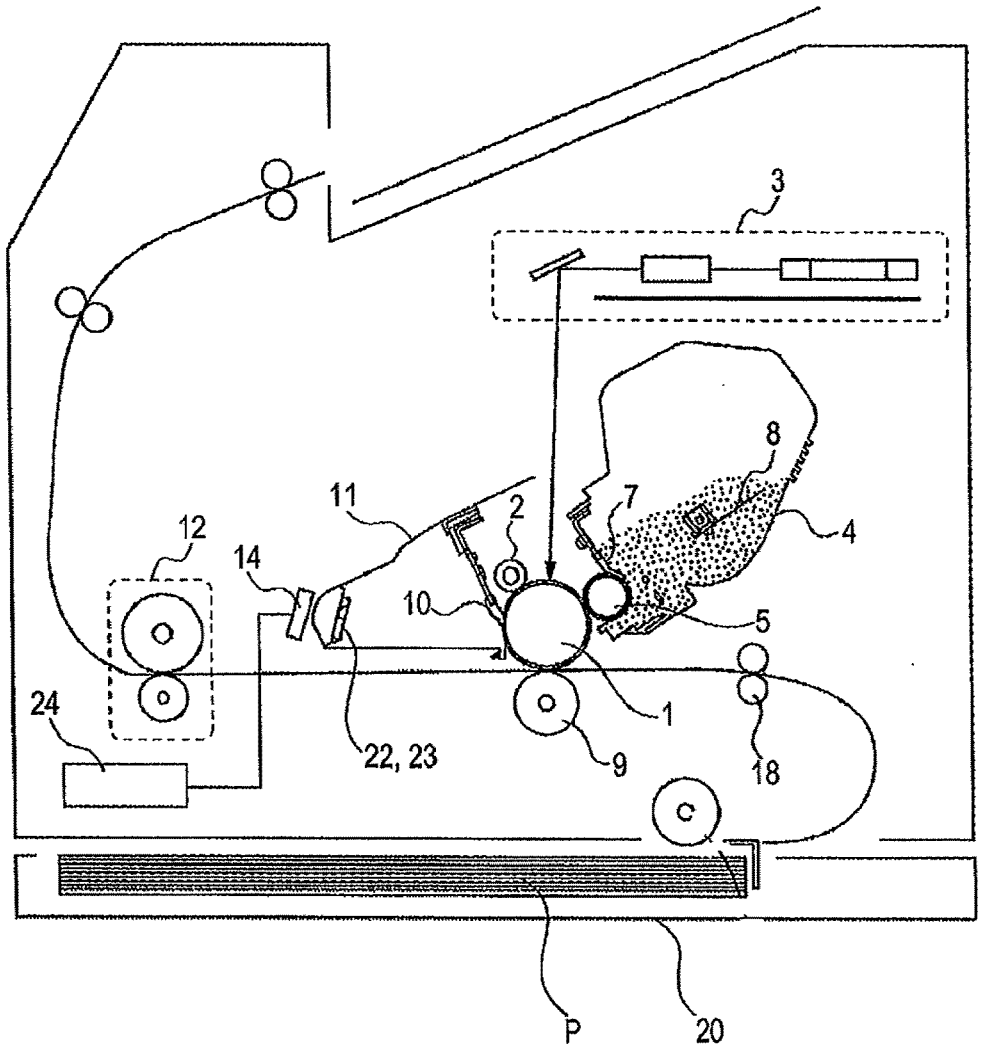
FIG. 2 is a sectional view of an image forming apparatus according to an embodiment of the present invention.

In the laser beam printer according to the embodiment shown in FIG. 2, the cylinder-shaped photosensitive drum 1 that acts as an image carrier rotates unidirectionally about its axis. The surface of the photosensitive drum 1 is uniformly charged by the charging roller 2, and then an electrostatic latent image is formed thereon by an exposing unit 3 (a semiconductor laser, an LED, or the like). The developing unit 4, with the toner t supplied thereto, develops the electrostatic latent image formed on the photosensitive drum 1 into a toner image. The developing sleeve 5 is connected to a bias-supplying power source (not shown) so that an appropriate developing bias formed by superposing an AC bias on the DC bias mentioned above is applied between the photosensitive drum 1 and the developing sleeve 5.

Referring to FIG. 2, transferring materials P that serve as recording media, contained in a feeding cassette 20, are forwarded to a resist roller 18 sheet by sheet, and are forwarded to a transferring unit by the resist roller 18 in synchronization with the image on the photosensitive drum 1.

In the transferring unit, the toner image developed with the toner t on the photosensitive drum 1 is transferred onto a transferring material P by a transferring roller 9. The transferring material P is then transported to a fixing unit 12, where the toner image is fixed by heat or pressure to form a recorded image.

The toner remaining on the photosensitive drum 1 after the transfer is removed by the cleaning blade 10 and is thereby collected in the waste-toner container 11. Then, the photosensitive drum 1 is charged again by the charging roller 2, and the procedure described above is repeated.

Next, a memory 22 that serves as a storage unit, included in the process cartridge (hereinafter simply referred to as a cartridge) C described above, will be described.

In this embodiment, the cartridge C includes a memory 22 disposed in a front region of the waste-toner container 11 with respect to the mounting direction, and a cartridge transmitter 23 for controlling reading and writing of information in the memory 22. The cartridge transmitter 23 has the function of transmitting data to the memory 22 and writing the data to the memory 22 or reading data from the memory 22. The cartridge transmitter 23 and the memory 22 are integrally formed on a substrate and included in the cartridge C. When the cartridge C is mounted on the main unit of an image forming apparatus, the cartridge transmitter 23 comes in contact with a main-unit transmitter 14 of the main unit of the image forming apparatus. The main-unit transmitter 14 is connected to a main-unit controller 24 of the main unit of the image forming apparatus, and it functions as a transmitter of the main unit of the image forming apparatus.

The memory 22 used in this embodiment may be implemented by various types of electronic semiconductor memories, such as EEPROM or FeRAM.

Although the cartridge transmitter 23 and the main-unit transmitter 14 come into contact with each other to establish a data communication path to carry out communication for reading and writing, alternatively, data communication may be carried out in a non-contact manner by electromagnetic waves. In this case, antenna members (not shown) for carrying out communications by electromagnetic waves are provided on a cartridge and a main unit of an image forming apparatus, respectively.

With the cartridge transmitter 23, the main-unit transmitter 14, and the main-unit controller 24, it is possible to read information from and write information to the memory 22. The capacity of the memory 22 is chosen so as to be sufficient for storing a plurality of pieces of information such as the amount of usage of the cartridge and cartridge characteristic values described later.

In the memory 22, usage-amount information of the cartridge C is written and stored at appropriate timing. The cartridge-usage-amount information stored in the memory 22 is not particularly limited to particular types of information as long as such information can be checked by the main unit of the image forming apparatus. For example, the cartridge-usage-amount information may include rotation times of units such as the photosensitive drum 1, the charging roller 2, and the developing sleeve 5, bias application times for units such as the charging roller 2 and the developing sleeve 5, the remaining amount of toner, the number of copies, the number of dots in an image formed on the photosensitive member, an accumulated time of laser emission for exposing the photosensitive member, the thickness of the photosensitive member, a value yielded by weighted combination of these values, a value calculated by using these values, and so forth.

Furthermore, the characteristic values of cartridges in accordance with characteristics of individual cartridges at the time of shipping serve as parameters for changing process conditions for image formation, and the characteristic values are stored in the memory 22 at the time of shipping from factories. As the parameters, for example, suitable values are stored in accordance with the manufacturing lots of photosensitive drums, electrical characteristic values of charging rollers, or urging forces of cleaning blades.

Based on these pieces of information stored in the memory 22, the main-unit controller 24 controls process conditions. That is, the main-unit controller 24 reads information in the memory 22 via the cartridge transmitter 23 and the main-unit controller 24, performs calculation using the information, and changes process conditions based on the result of the calculation.

In this embodiment, cartridges having different thicknesses of photosensitive layers of photosensitive drums and having different toner capacities are used as different types of cartridges that can be mounted on and dismounted from the same image forming apparatus.

First, difference in characteristics of latent images on photosensitive drums in relation to difference in the thicknesses of photosensitive layers of photosensitive drums will be described.

Figure 3:
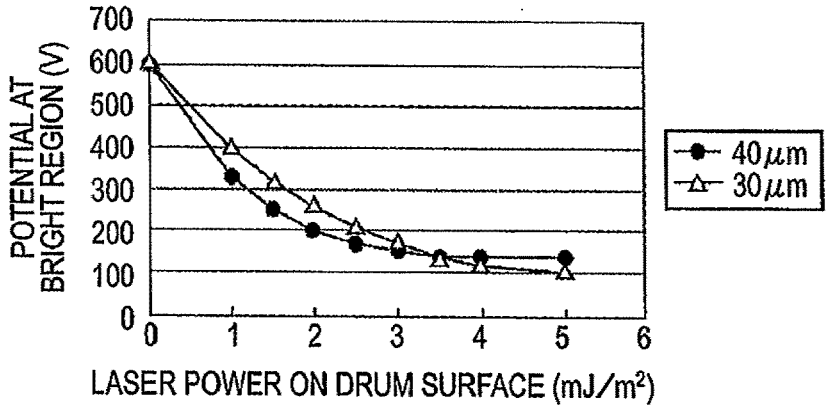
FIG. 3 is a graph showing characteristics of potentials in bright regions in relation to difference between the thicknesses of photosensitive layers of photosensitive drums.

Since the capacitances of photosensitive drums differ in accordance with the different thicknesses of the photosensitive layers of the photosensitive drums, when a predetermined amount of exposure light is cast on photosensitive drums having regions of the same dark-region potential (−600 V), the potential in bright regions differ depending on the thicknesses of the photosensitive layers. FIG. 3 shows difference between the potentials in bright regions in relation to exposure amount when the thicknesses of the photosensitive layers are 40 μm and 30 μm. When the thickness is small, the potential in bright regions becomes high when the exposure amount is small with a laser power of approximately 2.0 $mJ/m^2$ on the drum surface. That is, it is possible that the density differs due to the difference between the thicknesses of the photosensitive drums in the case of intermediate-tone images such as halftone images. As described above, even when the same image is formed, the density could vary depending on the difference between the thicknesses of the photosensitive layers of the photosensitive members.

When it is allowed to mount several types of cartridges having different thicknesses of photosensitive layers of photosensitive drums on the main unit of the same image forming apparatus, it is desired that the image density is the same even when an image is formed using all the different types of cartridges. Thus, the potential in bright regions should be appropriate irrespective of the thicknesses of the photosensitive layers of the photosensitive drums.

Figure 4:
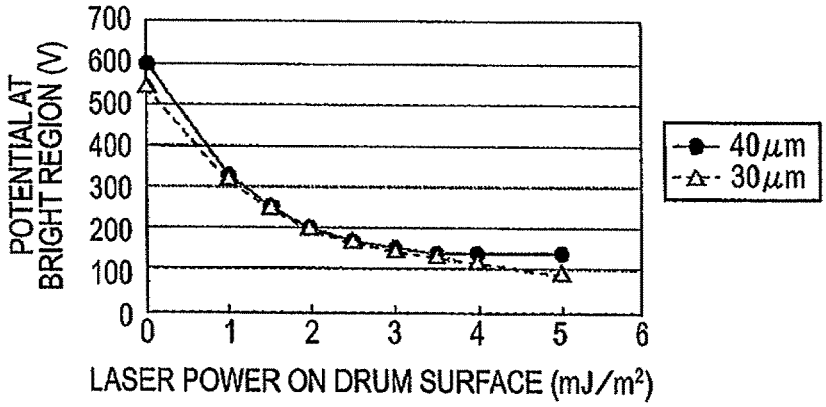
FIG. 4 is a graph showing an example of corrected potentials in bright regions in relation to difference between the thicknesses of photosensitive layers.

FIG. 4 shows change in the potential in bright regions in a case where the potential in dark regions is reduced by changing the DC voltage for the charging bias with a photosensitive drum having a photosensitive layer with a thickness of 30 μm. As will be understood from a comparison with FIG. 3, for a photosensitive drum having a thin photosensitive layer, by reducing the potential in dark regions, change in the potential in bright regions becomes close to that for a photosensitive drum having a photosensitive layer with a thickness of 40 μm. Thus, the densities of intermediate-tone images such as halftone images become substantially equal. Thus, by setting a laser power of 2.5 to 3.5 $mJ/m^2$ on the drum surface as the potential in bright regions, the difference in halftone density and maximum density due to the difference between the thicknesses of the photosensitive layers can be reduced.

However, when the potential in dark regions is reduced excessively, the difference from the developing potential (i.e., back contrast) becomes small. Thus, the density becomes somewhat higher even with the same developing contrast, and the amount of toner dispersed in white regions, called fogs, becomes larger. Thus, the DC voltage for the developing bias should be delicately adjusted so that the density and the range of fogs become appropriate, thereby increasing back contrast.

Alternatively, the potential in bright regions may be adjusted by adjusting the amount of laser exposure.

According to FIG. 3, when the drum thickness is initially 40 μm and the potential in bright regions is −160 V with an exposure amount of 2.7 $mJ/m^2$, the same potential in bright regions can be achieved with an exposure amount of 3.1 $mJ/m^2$ when the thickness has become 30 μm, whereby the difference in halftone potentials can be reduced.

Next, difference in developing characteristics that can occur due to difference in toner capacity will be described.

Figure 5:
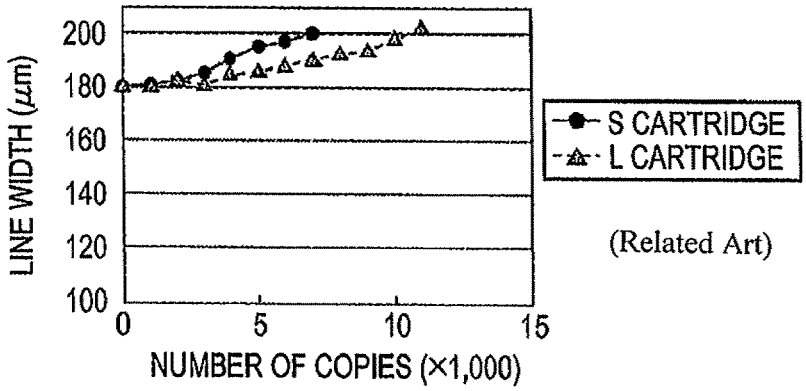
FIG. 5 is a graph showing changes in line width with S and L cartridges according to the related art.

FIG. 5 shows change in line width of 4-dot line (resolution of 600 dpi) in relation to the usage amount of the photosensitive drum (number of copies) in an S cartridge with a toner capacity corresponding to 5,000 sheets and an L cartridge with a toner capacity corresponding to 10,000 sheets. In this example, the S cartridge and the L cartridge differ only in the toner capacity.

The change in line width is substantially the same between the S and L cartridges in the initial periods of usage. In subsequent periods, however, the line width for the S cartridge with a shorter life span becomes thicker more quickly than the line width for the L cartridge with a longer life span. Although the line width for the L cartridge with a longer life span becomes thicker less quickly than that for the S cartridge with a shorter life span, the line width tends to become as thick as 200 μm in the end of its life span similarly to the S cartridge.

When the toner capacity is small, circulation of toner through stirring by a stirring member or the like is good. Accordingly, generally toner gets charged more quickly. Therefore, compared with a case where the toner capacity is large, when the toner is supplied to the developing unit, the toner quickly gets charged by an appropriate amount, so that development characteristics are improved. Thus, according to the development characteristics of the S cartridge, the change in line width is larger than the L cartridge. On the other hand, in the case of the L cartridge with a large toner capacity, the toner gets charged less quickly, so that the line width gets thicker less quickly than the S cartridge, and the line width increases quickly when the amount of toner remaining in the developer container becomes small.

As described above, development characteristics differ depending on the amount of toner contained. Thus, control is to be exercised according to the amount of toner contained so that stable development characteristics are achieved.

This can be achieved, for example, by changing the AC or DC voltage for the charging or developing bias or by adjusting the amount of laser exposure.

Furthermore, it is possible to exercise control for achieving stable development characteristics based on other information that allows estimating the amount of toner consumed, such as the cumulative number of dots of image information of images formed on the photosensitive drum, the number of copies, or the amount of usage of the cartridge according to the driving time of the cartridge and coefficient information. In this case, the charging or developing bias or the amount of laser exposure is adjusted when the cumulative number of dots of image information, the number of copies, or the cartridge usage amount reaches a predetermined value (predetermined threshold information).

In this embodiment, in order to adjust difference in latent-image characteristics or development characteristics depending on the types of cartridges, control is exercised in the following manner using information regarding the cartridge usage amount.

(1) Information regarding cartridge type is stored in the memory 22 in the cartridge C.

(2) The time during which the cartridge C is driven in the main unit of the image forming apparatus is stored in the memory 22.

(3) Coefficient information for an equation, determined in accordance with the urging force of the photosensitive drum 1 and the cleaning blade 10 and electrical characteristics of the charging roller 2, and threshold information that serves to determine timing for changing process conditions, are stored in the memory 22 at the time of manufacturing.

(4) In the main unit of the image forming apparatus, the type of the cartridge is identified, and the usage amount of the cartridge C (e.g., the usage amount of the photosensitive drum 1) is calculated according to the driving time and coefficient information stored in the memory 22 of the cartridge C. Then, the usage amount is compared with the threshold information regarding the usage amount, which is determined in advance according to the characteristics of the photosensitive material of the photosensitive drum 1 and stored in the memory 22 of the cartridge C. Then, the process conditions are changed when the value calculated reaches the threshold.

A plurality of pieces of threshold information may be prepared and stored in the memory 22 of the cartridge C so that the exposure amount and the charging and developing biases can be changed a plurality of times. Thus, the potentials in bright regions become stable over the usage period of the photosensitive drum 1. This serves to achieve improved (i.e., stable) quality of images formed. Furthermore, the threshold information may be stored in the memory 22 of the cartridge C together with information regarding setting of process conditions to be changed.

Now, features of this embodiment will be described more specifically with reference to FIGS. 6 and 7.

In this embodiment, photosensitive-drum usage-amount information calculated based on photosensitive-drum rotation time is used as information regarding the cartridge usage amount. This corresponds to the photosensitive-drum usage amount calculated based on a damage index of the photosensitive drum, which is disclosed in Japanese Patent No. 3285785.

Figure 6:
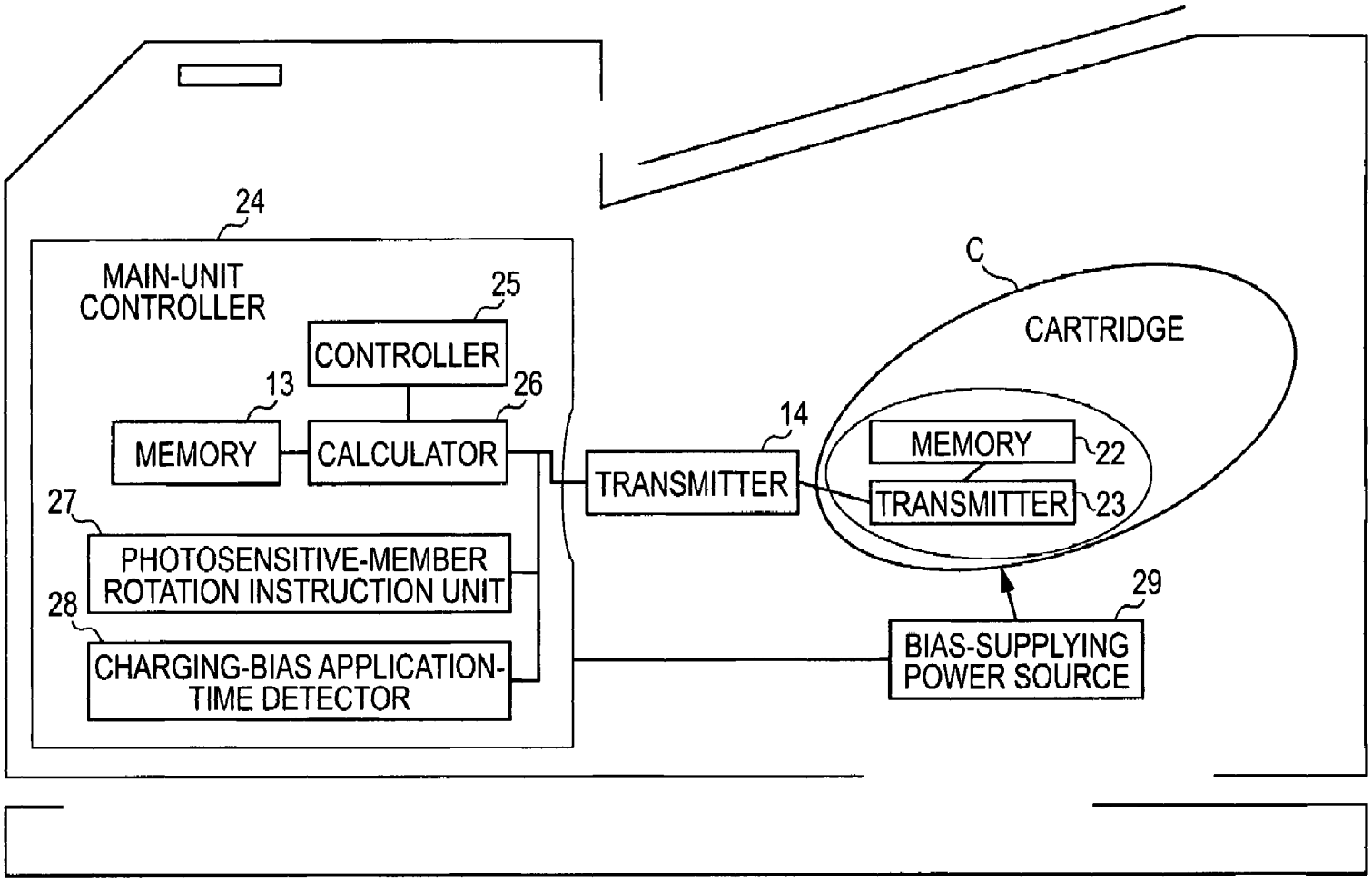
FIG. 6 is a block diagram of an image forming apparatus and a process cartridge according to an embodiment of the present invention.

As shown in FIG. 6, the main-unit controller 24 includes a data-storage memory 13, a controller 25, a calculator 26, a photosensitive-member rotation instruction unit 27, a charging-bias application-time detector 28, and a main-unit transmitter 14. The main-unit controller 24 is connected to a bias-supplying power source 29. The cartridge C includes the memory 22 and the transmitter 23.

Figure 7:
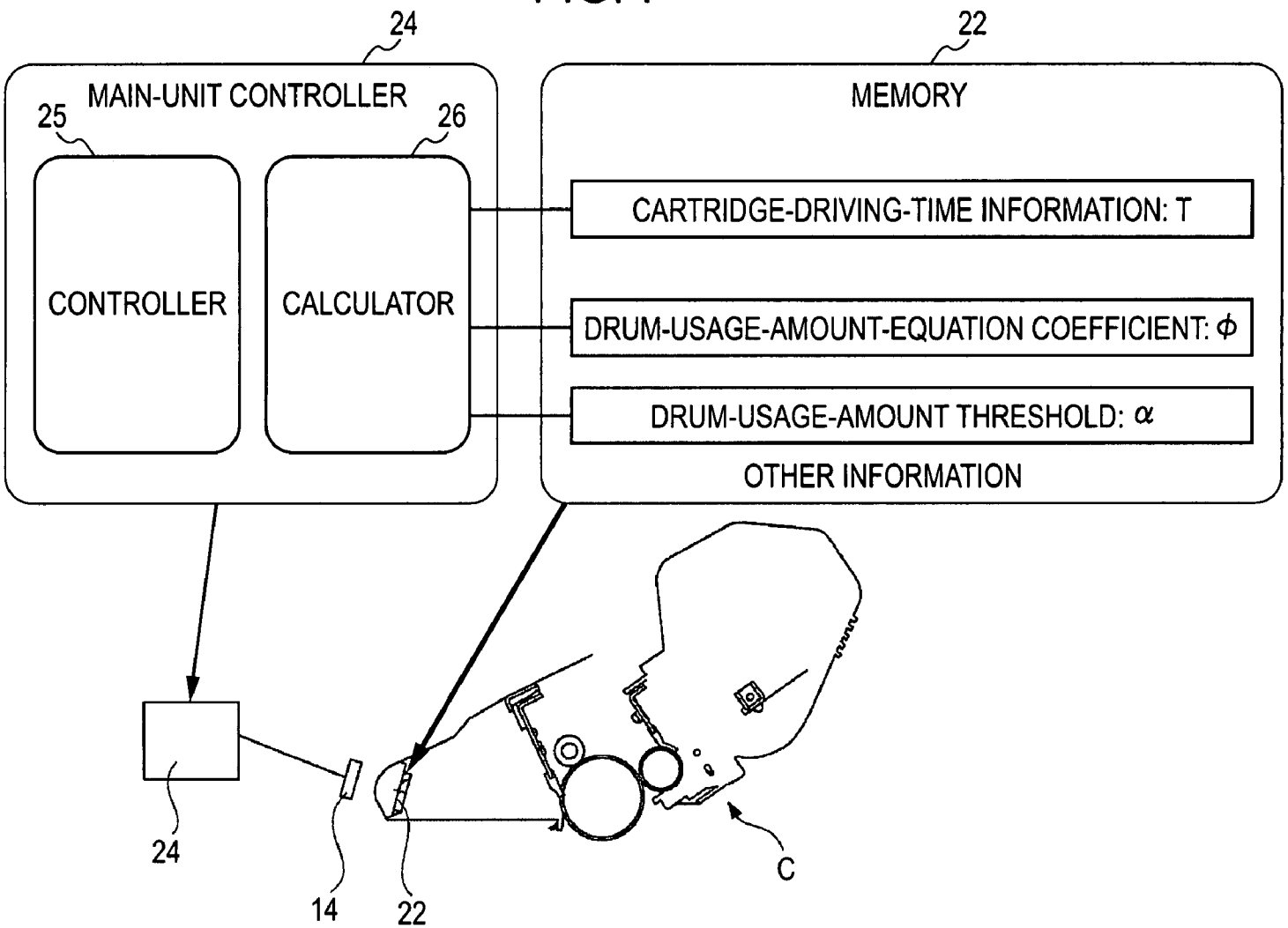
FIG. 7 is a diagram showing the scheme of memory control according to an embodiment of the present invention.

As shown in FIG. 7, the memory 22 in the cartridge C includes cartridge-driving-time information T, drum-usage-amount-equation coefficient information $\phi$ that serves as a weighting coefficient for calculating the photosensitive-drum usage amount, photosensitive-drum usage-amount threshold information $\alpha$, and information representing a table for setting image forming conditions in accordance with the photosensitive-drum usage-amount threshold information. The drum-usage-amount threshold information $\alpha$ and the drum-usage-amount-equation coefficient information $\phi$ are stored in the memory 22 at the time of shipping of the cartridge C. These values vary depending on drum sensitivity, drum material, urging force of the cleaning blade 10, and electrical characteristics of the charging roller 2, so that these values are stored in the individual memories of the cartridges C at the time of shipping.

Next, a control operation according to this embodiment will be described.

When a print signal is received by the main unit of the image forming apparatus, the photosensitive-member rotation instruction unit 27 drives the cartridge C, whereby an image formation process is started. At this time, the drum usage amount is calculated in the following manner.

Based on a value B obtained by accumulating the photosensitive-drum rotation-time data (corresponding to the cartridge-driving-time information T) from the photosensitive-member rotation instruction unit 27, a value A obtained by accumulating the charging-bias application-time data from the charging-bias application-time detector 28, and a weighting coefficient $\phi$ read from the memory 22, the calculator 26 calculate the drum usage amount D according to $D=A+B\times\phi$, and stores the result in the main-unit memory 13 for storing main-unit data. The calculator 26 compares the drum usage amount D accumulated and stored with the threshold $\alpha$ in the memory 13 in the main unit of the image forming apparatus. When it is determined by the comparison that the drum usage amount D has become greater than the threshold $\alpha$, the controller 25 sends a control signal to a high-voltage circuit (not shown) in the bias-supplying power source 29, whereby the DC voltage for the charging or developing bias is changed.

The photosensitive-drum rotation-time data and the charging-bias application-time data are stored in the memory 22 at appropriate timing, and data of the drum usage amount is calculated at appropriate timing when the driving of the photosensitive drum 1 is stopped. Instead of storing the photosensitive-drum rotation-time data and the charging-bias application-time data in the memory 22, the result of calculation of the drum usage amount D may be written to the memory 22.

In this embodiment, a plurality of tables is provided, the tables including sets of a plurality of process conditions with consideration of latent-image characteristics of the photosensitive drum, which depend on the thickness of the photosensitive layer thereof, and development characteristics that depend on toner amount, and process conditions are set by selecting one of the tables from the plurality of tables based on cartridge type and usage amount.

In this embodiment, the following combinations of process conditions may be used:

(1) Exposure amount and charging and developing bias Latent-image characteristics are controlled mainly by the amount of exposure, and development characteristics are controlled mainly by the charging and developing DC voltages. Alternatively, latent-image characteristics are controlled by the charging and developing DC voltages, and development characteristics are controlled by the amount of exposure.

(2) The charging and developing biases alone Both latent-image characteristics and development characteristics are controlled by the charging and developing DC voltages.

The combinations of process conditions will be described below in detail.

FIRST EXAMPLE

Control by the Exposure Amount and the Charging and Developing Biases

A first example will be described in the context of the following cartridges C having different toner capacities and different thicknesses of photosensitive layers of photosensitive drums.

S cartridge: Toner capacity corresponding to 5,000 sheets (5% printing), and photosensitive-layer thickness of 30 μm L cartridge: Toner capacity corresponding to 10,000 sheets (5% printing), and photosensitive-layer thickness of 40 μm. Latent-image characteristics are controlled by switching among four levels of the exposure amount shown in Table 1 according to the amount of wear of the photosensitive layer. Development characteristics are controlled by switching among three levels of the charging DC voltage and the developing DC voltage.

TABLE 1

| | Setting number | | | |
|---|---|---|---|---|
| | 1 | 2 | 3 | 4 |
| Luminance on drum surface | 2.7 mJ/m$^2$ | 3.0 mJ/m$^2$ | 3.2 mJ/m$^2$ | 3.5 mJ/m$^2$ |

Figure 8:
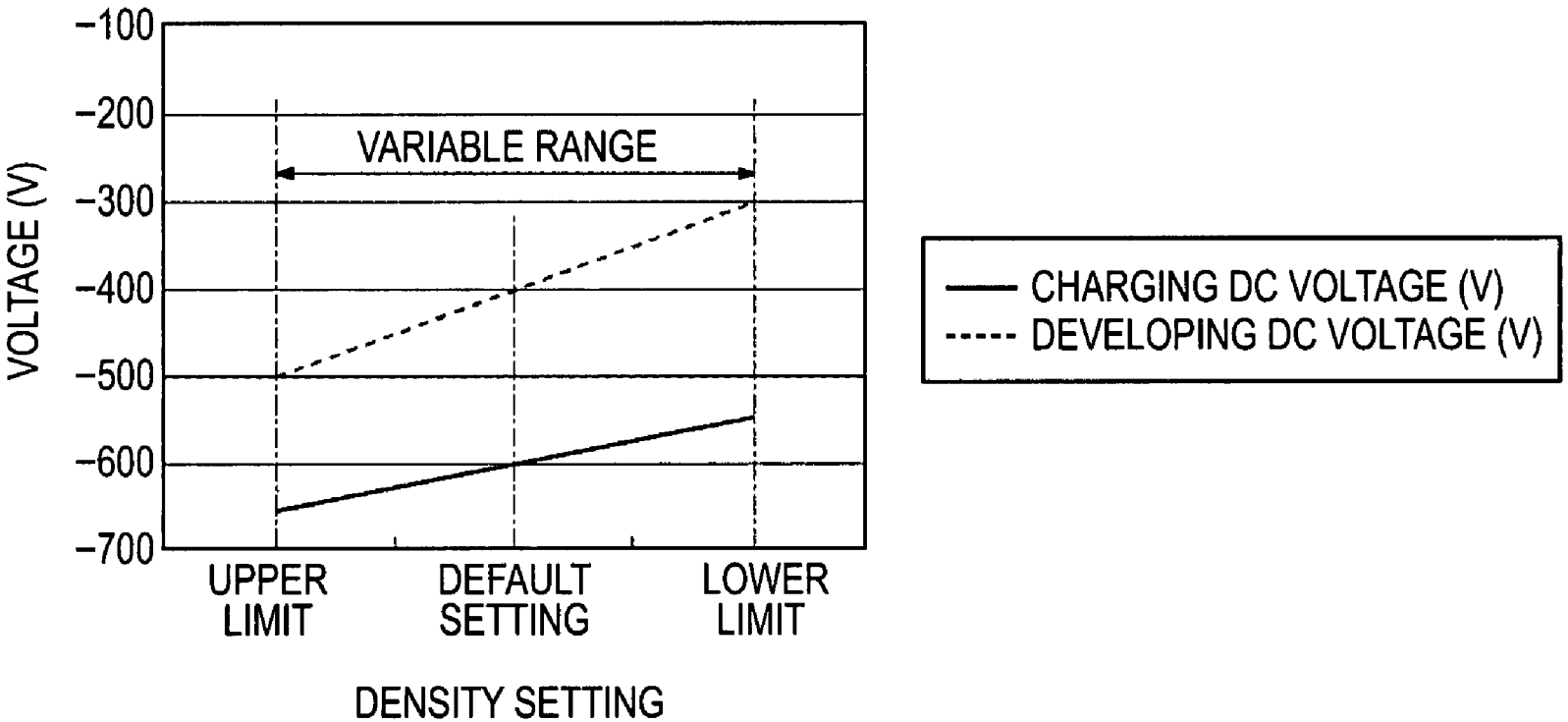
FIG. 8 is a diagram for explaining density adjustment with DC voltages.

For the switching of the charging DC voltage and the developing DC voltage, when the density is adjusted by changing DC voltages of the charging bias and the developing bias as shown in FIG. 8, three patterns of voltage setting, namely, default setting, upper limit (higher density), and lower limit (lower density), are provided as shown in Table 2.

TABLE 2

| Density | Charging DC voltage (V) | Developing DC voltage (V) |
|---|---|---|
| | (I) | |
| Upper limit | −670 | −540 |
| Default | −620 | −440 |
| Lower limit | −570 | −340 |
| | (II) | |
| Upper limit | −650 | −500 |
| Default | −600 | −400 |
| Lower limit | −550 | −300 |
| | (III) | |
| Higher density | −640 | −480 |
| Default | −590 | −380 |
| Lower density | −540 | −280 |

Based on the change in density and line width due to the difference in latent-image characteristics and development characteristics between the S and L cartridges, a table including seven combinations of exposure amount, charging DC voltage, and developing DC voltage, shown in Table 3, is prepared.

TABLE 3

| | a | b | c | d | e | f | g |
|---|---|---|---|---|---|---|---|
| Exposure amount setting | 1 | 1 | 2 | 2 | 3 | 3 | 4 |
| Charging/developing DC voltage setting | I | II | I | II | II | III | III |

The speed of wear (degree of wear) of the photosensitive drum in relation to the number of sheets passed was confirmed to be 1 μm/1,000 sheets in 1 sheet/job mode.

The value A, obtained by accumulating the charging-bias application-time data, is 10, the value B, obtained by accumulating the photosensitive-drum rotation-time data, is 5, and the weighting coefficient $\phi$ is 2, so that the drum usage amount D for printing a single sheet is calculated as D=20 (10+5×2).

Figures 9A, 9B:
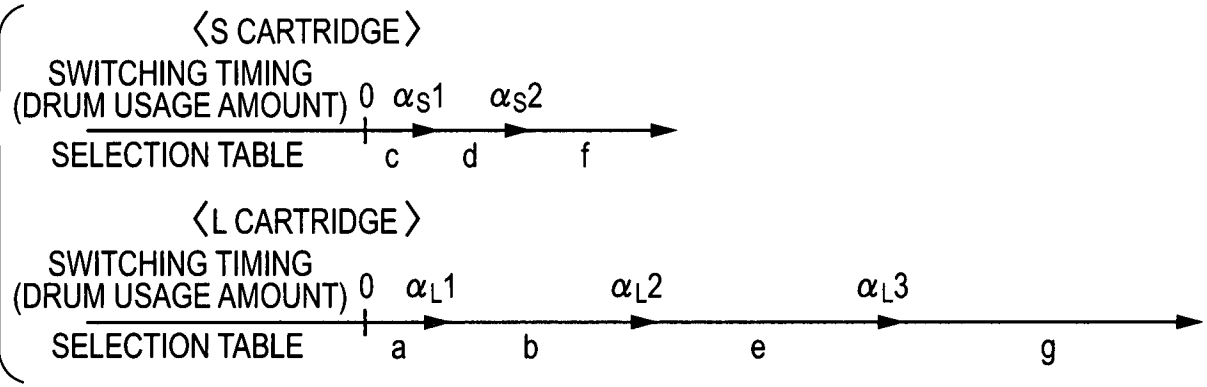
FIGS. 9A and 9B are diagrams showing timing of switching process setting in a first example.

Accordingly, based on the wearing amount of photosensitive drum in relation to the number of sheets passed and based on the development characteristics, setting of threshold information $\alpha$ and selection of a table was determined as shown in FIGS. 9A and 9B.

Figure 16:
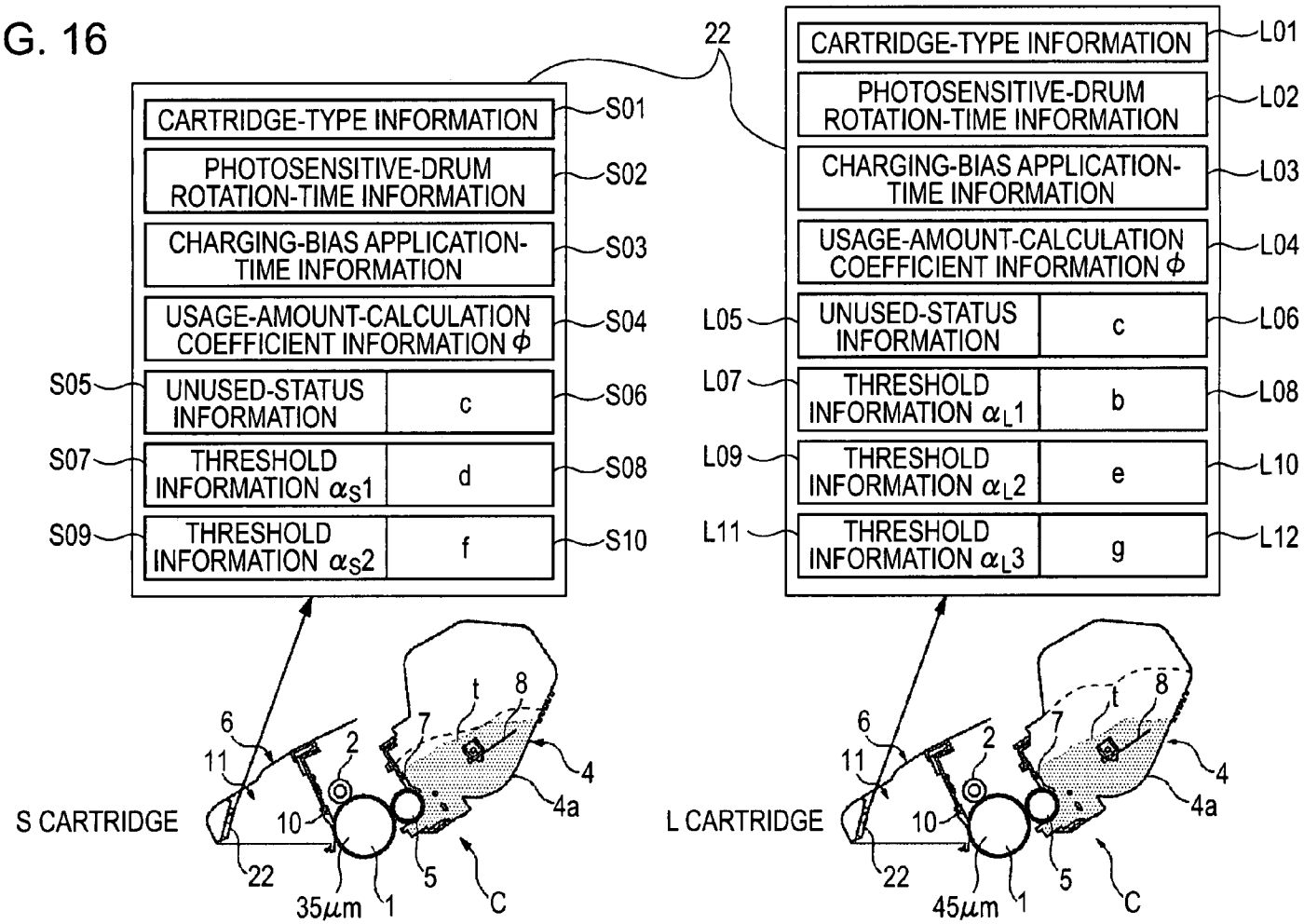
FIG. 16 is a diagram showing specific contents stored in a memory in the first example.

FIG. 9A shows switching timing of the table shown in FIG. 3 and table setting that is selected. FIG. 9B shows detailed information of the switching timing. As shown in FIG. 9A, in order to set process conditions by selecting tables at different timing between the S cartridge and the L cartridge, the content shown in FIG. 16 is stored in the memories of the S cartridge and the L cartridge.

The memories in the S cartridge and the L cartridge include storage areas S01 to S10 and L01 to L12, respectively. The contents stored in the storage areas are as follows:

S01 and L01: Cartridge-type information indicating whether the cartridge is an S cartridge or an L cartridge S02 and L02: Rotation-time information of photosensitive drum during printing using the cartridge S03 and L03: Application-time information representing time in which the charging bias is applied to a charging unit (the charging roller 2) during printing using the cartridge S04 and L04: Calculation coefficient information used for calculating the usage amount of the photosensitive drum S05 and L05: Information indicating whether the cartridge is unused S06 and L06: Information for setting initial process conditions for using the cartridge (values shown in table 3)

S07, S09, L07, L09, and L11: Threshold information regarding the photosensitive-drum usage amount (process conditions are changed when the photosensitive-drum usage amount reaches the threshold)

S08, S10, L08, L10, and L12: Information for selecting process conditions in accordance with the photosensitive-drum usage amount (values shown in table 3, stored in association with threshold information)

The S cartridge and the L cartridge are constructed substantially the same, but have different toner capacities and different thicknesses of photosensitive layers of photosensitive drums as described earlier. The S cartridge has a toner capacity corresponding to 5,000 sheets (assuming A4 sheets and 5% printing), and a photosensitive-layer thickness of 30 μm. The L cartridge has a toner capacity corresponding to 10,000 sheets (assuming A4 sheets and 5% printing), and a photosensitive-layer thickness of 40 μm.

In each of these cartridges, process conditions (exposure condition and charging and developing conditions) are changed according to the photosensitive-drum usage amount as shown in FIGS. 9A and 9B.

Next, an operation of the image forming apparatus according to this embodiment will be described with reference to FIGS. 16 and 10.

START: A control operation is started.

S101: The main unit of the image forming apparatus is powered on.

S102: The controller 24 of the main unit recognizes the type of a cartridge C mounted. More specifically, the controller 24 reads information stored in the storage area S01 (L01 in the case of the L cartridge) of the memory 22 and recognizes the cartridge C either as an S cartridge or an L cartridge, and, for example, displays the cartridge type on an operation panel of the main unit of the image forming apparatus.

S103: Then, the controller 24 reads unused-status information indicating whether the cartridge C is unused from the storage area S05 of the memory 22. When it is indicated that the cartridge C is unused, the controller 24 updates the information so that the information indicates that the cartridge C has been used. Then, the controller 24 reads information c for setting initial process conditions for usage from the storage area S06 of the memory 22. The information c is data in Table 3. In this case, process conditions associated with the information c is set as initial process conditions for usage. The information c is stored in the memory 13 as initial values for the usage of the cartridge C.

S104: The main-unit controller 24 reads threshold information αsi stored in the storage area S07 (L07 in the case of an L cartridge) of the memory 22, and stores the threshold information αsi in the memory 13 of the main-unit controller 24 (the initial value of i is 1).

S105: The main-unit controller 24 reads information representing accumulated values of the photosensitive-member rotation time and the charging-bias application time from the storage areas S02 and S03 (L02 and L03 in the case of an L cartridge) of the memory 22 of the cartridge C.

S106: The image forming apparatus enters a print-ready state (a state where print signals can be accepted), and waits for reception of print signals.

S107: Print signals are turned on.

S108: The photosensitive-member rotation-time detector 28 starts counting the rotation time, and adds the rotation time to the photosensitive-member rotation time read from the memory 22.

S109: The charging-bias application-time detector 28 starts counting the charging-bias application time, and adds it to the charging-bias application time read from the memory 22.

S110: Printing is finished.

S111: The main-unit controller 24 reads the weighting coefficient ϕ from the storage area S04 (L04 in the case of the L cartridge) of the memory 22 of the cartridge C.

S112: The calculator 26 calculates the drum usage amount D based on the photosensitive-drum rotation time and the charging-bias application time calculated in step S108 and S109 and the weighting coefficient ϕ read from the memory 22.

S113: The calculator 26 reads the threshold information αsi from the memory 13 in the main-unit controller 24.

S114: The calculator 26 compares the drum-usage-amount data D with the drum-usage-amount equation threshold αsi. That is, the calculator 26 determines whether D>αsi. When the evaluation results in "YES", the procedure proceeds to step S115. On the other hand, when the evaluation results in "NO", the procedure returns to step S105, and the control operation is repeated.

S115: The main-unit controller 24 reads a table setting value d associated with the drum-usage-amount equation threshold αs1 from the storage area S08 (L08 in the case of an L cartridge) of the memory 22 of the cartridge, and changes process conditions (exposure amount, and charging and developing DC voltages) based on the table setting value d shown in Table 3. The value of c stored in the memory 13 in step S103 is replaced by the value of d (i.e., the content of the memory 13 is rewritten each time the setting value is changed).

S116. i is incremented so that i=i+1. The procedure then returns to step S106, and the control operation is repeated.

In each of the S and L cartridges, multiple printings were performed in a condition which each image has a 2% print ratio (2% print data in a page) and one print job has one page, and the printed images were evaluated for every predetermined number of printed sheets (the number of total printed sheets; 0 to 15,000).

Figure 11:
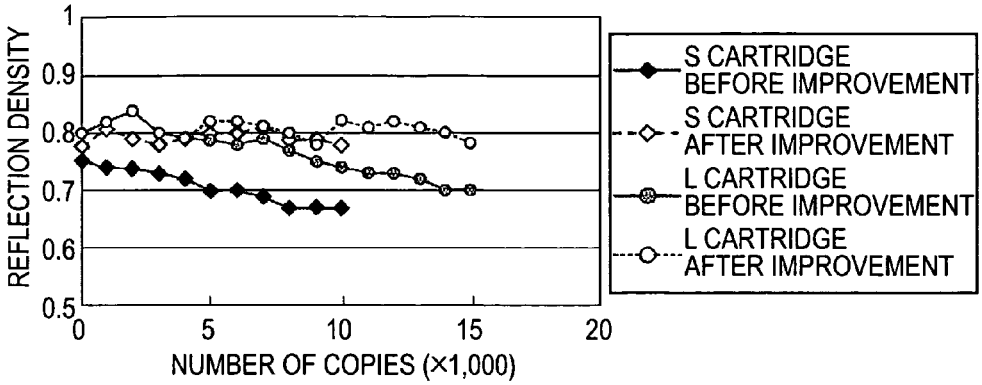
FIG. 11 is a graph showing effects of an embodiment of the present invention at halftone densities.
Figure 12:
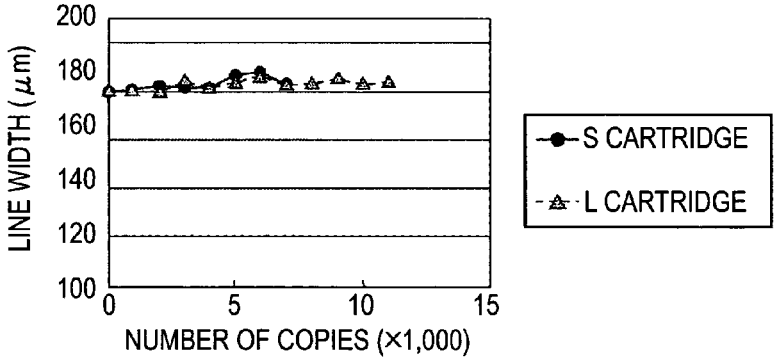
FIG. 12 is a graph showing change in line width in the first example.

FIG. 11 shows change in density in halftone images having a print ratio of 25%, formed of isolated single dots. FIG. 12 shows change in line width of 4-dot line (a resolution of 600 dpi). It was confirmed that irrespective of the different types of cartridges, stable halftone densities and line widths were achieved over the life span of the cartridges, and images of good quality without fogs were obtained. At every 1,000 printings, printing of a halftone image having a 25% print ratio was performed, and the density change in the printed halftone image is confirmed (checked). Furthermore, at every 1,000 printings, printing of an image having a line width of 4-dot was performed, and the change in the line width is confirmed (checked).

Furthermore, the values (a to g) in Table 3, selected in accordance with the respective drum usage amounts of the S cartridge and the L cartridge, are set individually for the S and L cartridges, it is possible that the same table value is selected depending on the setting of photosensitive-layer thicknesses and toner capacities and associated change in density and line width. For example, it is possible that c=f in the table setting.

The threshold information for switching table is also independent between the S and L cartridges. However, it is possible that the amount of wear of photosensitive drums is the same between the S and L cartridges. Thus, selection of table setting may be switched based on the same threshold information.

The construction of the cartridge C in FIG. 16 has been described earlier, so that description thereof will be omitted.

SECOND EXAMPLE

Control Based on the Charging and Developing Biases Alone

In this embodiment, by switching the setting of the DC voltages of the charging and developing biases, including upper limits and lower limits described in the context of the first example, change in density or line width due to difference in latent-image characteristics and development characteristics between different types of cartridges is reduced.

In this example, three patterns of setting including upper and lower limits of density are provided as (I) to (III) in Table 4. The setting serves to reduce the DC voltage of the charging bias so that the potential of latent image will be constant and to reduce the DC voltage of the developing bias according to the change of the charging bias so that a certain degree of back contrast is achieved to prevent occurrence of fogs.

TABLE 4

| Density | Setting value | Charging DC voltage (V) | Developing DC voltage (V) |
|---|---|---|---|
| | | (I) | |
| Upper limit | 0 | −650 | −500 |
| Default | 5 | −600 | −400 |
| Lower limit | 10 | −550 | −300 |
| | | (II) | |
| Upper limit | 0 | −620 | −480 |
| Default | 5 | −550 | −380 |
| Lower limit | 10 | −480 | −280 |
| | | (III) | |
| Higher density | 0 | −580 | −450 |
| Default | 5 | −500 | −350 |
| Lower density | 10 | −420 | −250 |

Figure 13:
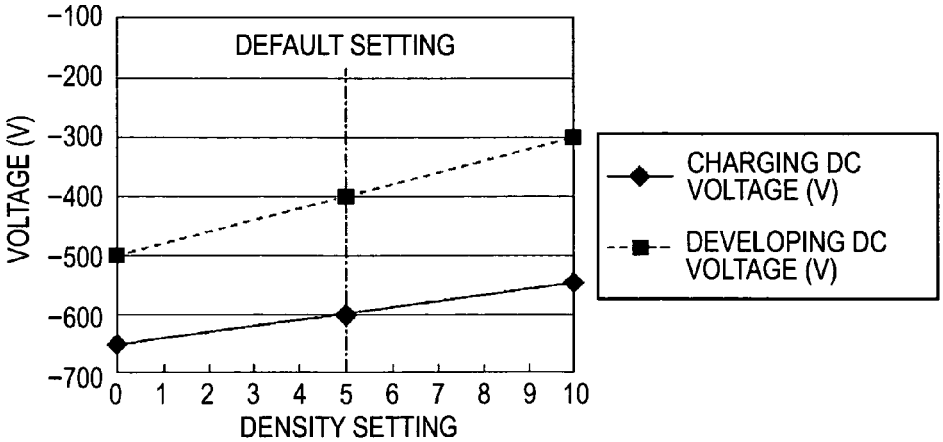
FIG. 13 is a diagram for explaining a case where the setting of a density center can be changed with DC voltages.

The development characteristics can be corrected by changing the default value of density in the setting of the charging and developing DC voltages selected from (I) to (III) in Table 4. For example, 10 levels of bias setting from the upper limit to the lower limit can be selected as shown in FIG. 13. The default setting corresponds to level 5. For example, when lines are due to development characteristics, level 3 is selected as DC voltage setting so that the density will be increased. When the density becomes higher, level 5 is selected. Accordingly, stable development characteristics are achieved.

Based on the changes in density and line width due to difference in latent-image characteristics and development characteristics of the S and L cartridges, a table including six combinations of DC voltage setting and default density setting, shown in Table 5, is prepared. As described earlier, the voltage density setting is selected from setting values of 0 to 10 defined at regular intervals, with 0 representing the upper limit (higher density) and 10 representing the lower limit (lower density).

TABLE 5

| | h | i | j | k | l | m |
|---|---|---|---|---|---|---|
| Charging and developing DC voltages setting | I | I | II | II | III | III |
| Default setting | 5 | 6 | 5 | 7 | 6 | 7 |

For example, in the case of the S cartridge, the default density setting of the DC voltages for the charging and developing biases are as shown in Table 6.

When the drum usage amount reaches the threshold defined by the threshold information αs1, in order to reduce increase in line width due to improvement in toner development characteristics (i.e., quick rising is achieved) due to the development characteristics of the S cartridge shown in FIG. 5, the table setting is changed from j to k, so that the default density setting is changed from 5 to 7 within the same DC voltage setting (II).

When the drum usage amount reaches the threshold defined by the threshold information αs2, the table setting is changed from k to 1. Mainly for the purpose of correcting latent-image characteristics due to the reduction in the thickness of the photosensitive layer of the photosensitive drum, DC voltage setting is changed to (III), and the default density setting is changed to 6 so that change in line width is corrected delicately.

TABLE 6

| Table setting | j | k | l |
|---|---|---|---|
| Charging DC voltage | −550 V | −522 V | −484 V |
| Developing DC voltage | −380 V | −340 V | −330 V |

As described above, in order to correct latent-image characteristics of the cartridge and to thereby achieve back contrast in accordance with the photosensitive-drum usage amount, tables (I) to (III) of the charging bias and the developing bias are prepared, and development characteristics are corrected by changing the default density setting in each of the tables.

Figure 14:
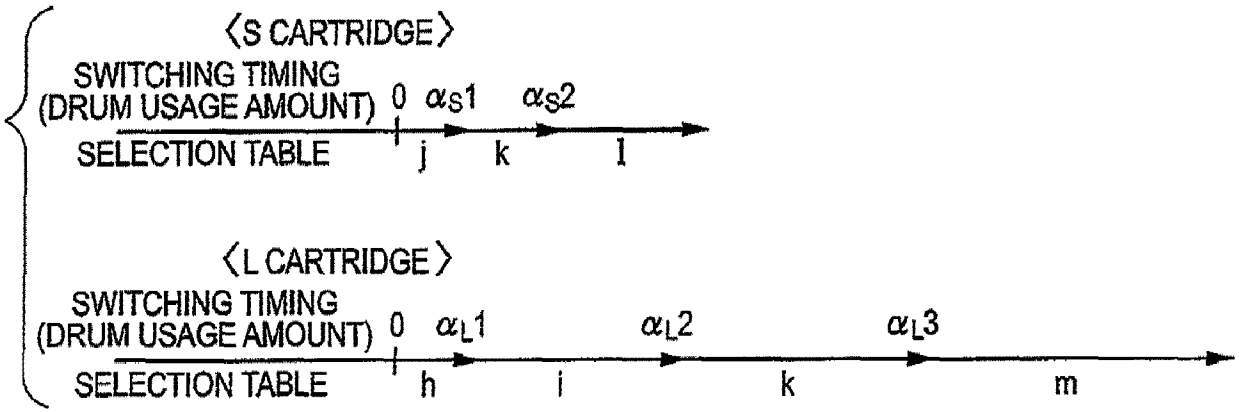
FIG. 14 is a diagram showing timing of switching process setting in a second example.
Figure 15:
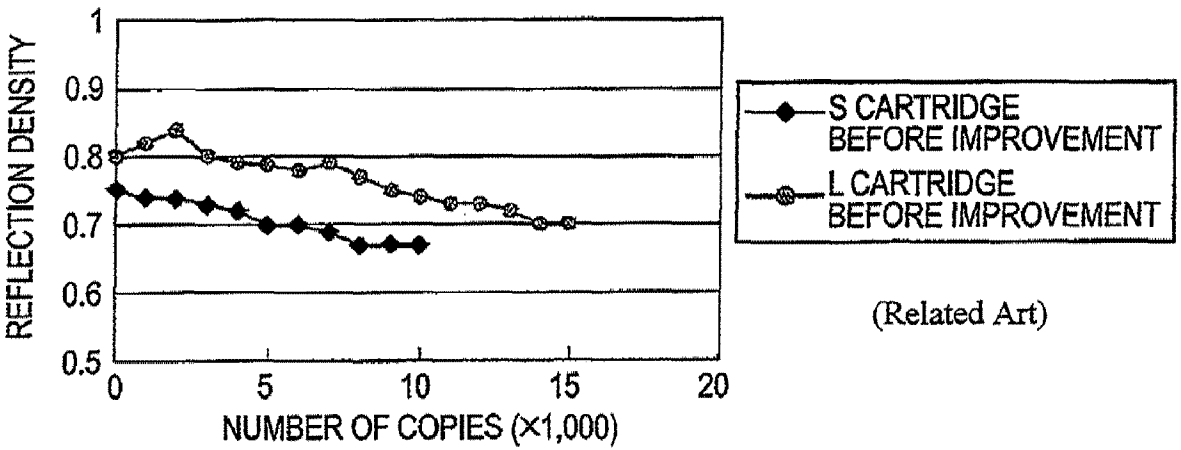
FIG. 15 is a graph showing changes in halftone densities with different types of cartridges according to the related art.

When control was exercised as shown in FIG. 14 at the same switching timing as that shown in FIG. 9B, advantages similar to those in the first example were achieved.

Figure 17:
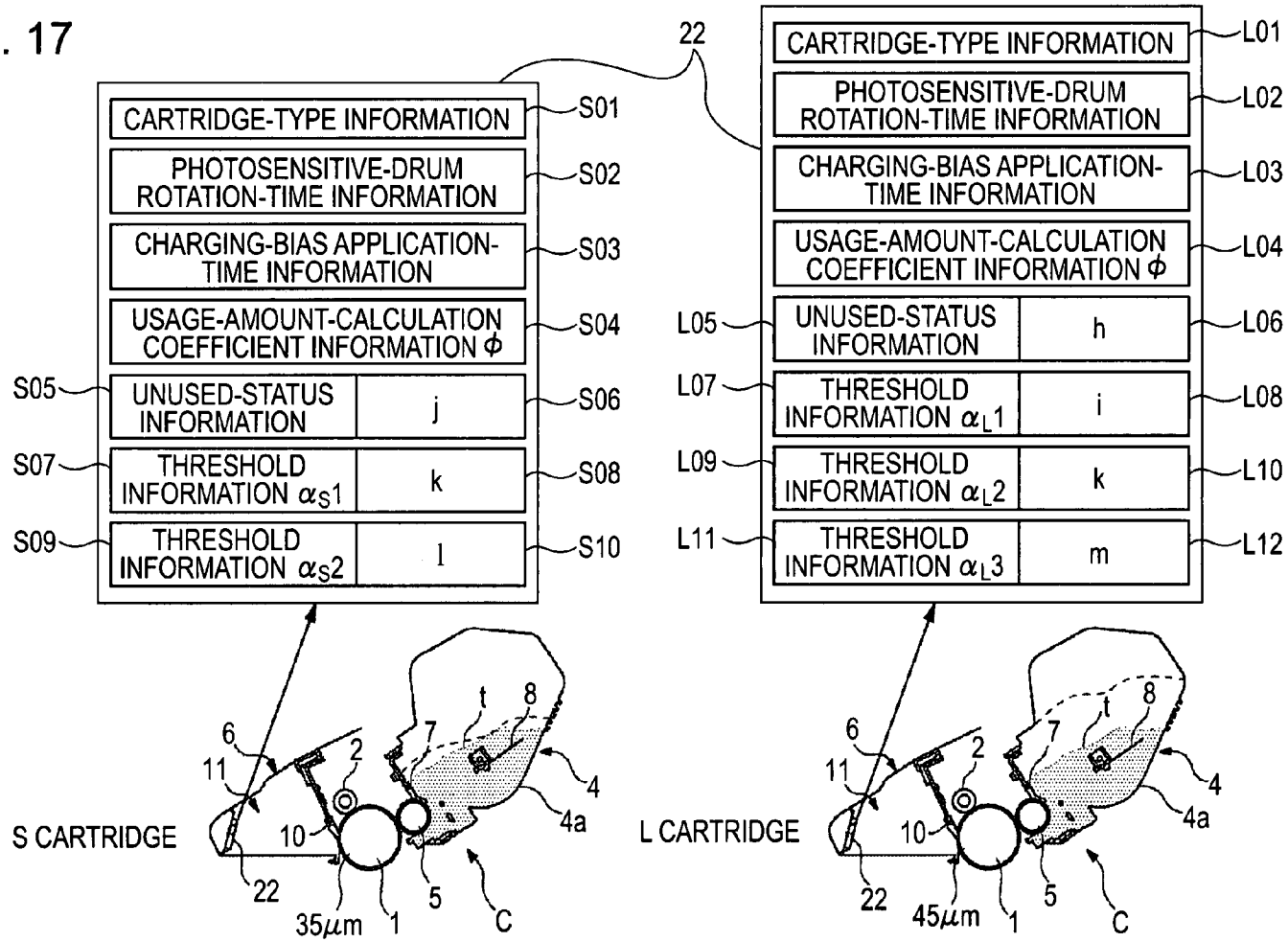
FIG. 17 is a diagram showing specific contents stored in a memory in the second example.

FIG. 17 shows contents stored in the memories 22 of the S and L cartridges in this example. The contents stored are basically the same as those in the first example (FIG. 16). However, the values of the threshold information α (storage areas S05 and S07) and setting values (storage areas S06, S08, S10, L06, L08, L10, and L12) stored in association therewith differ from those in the first example.

Figure 10:
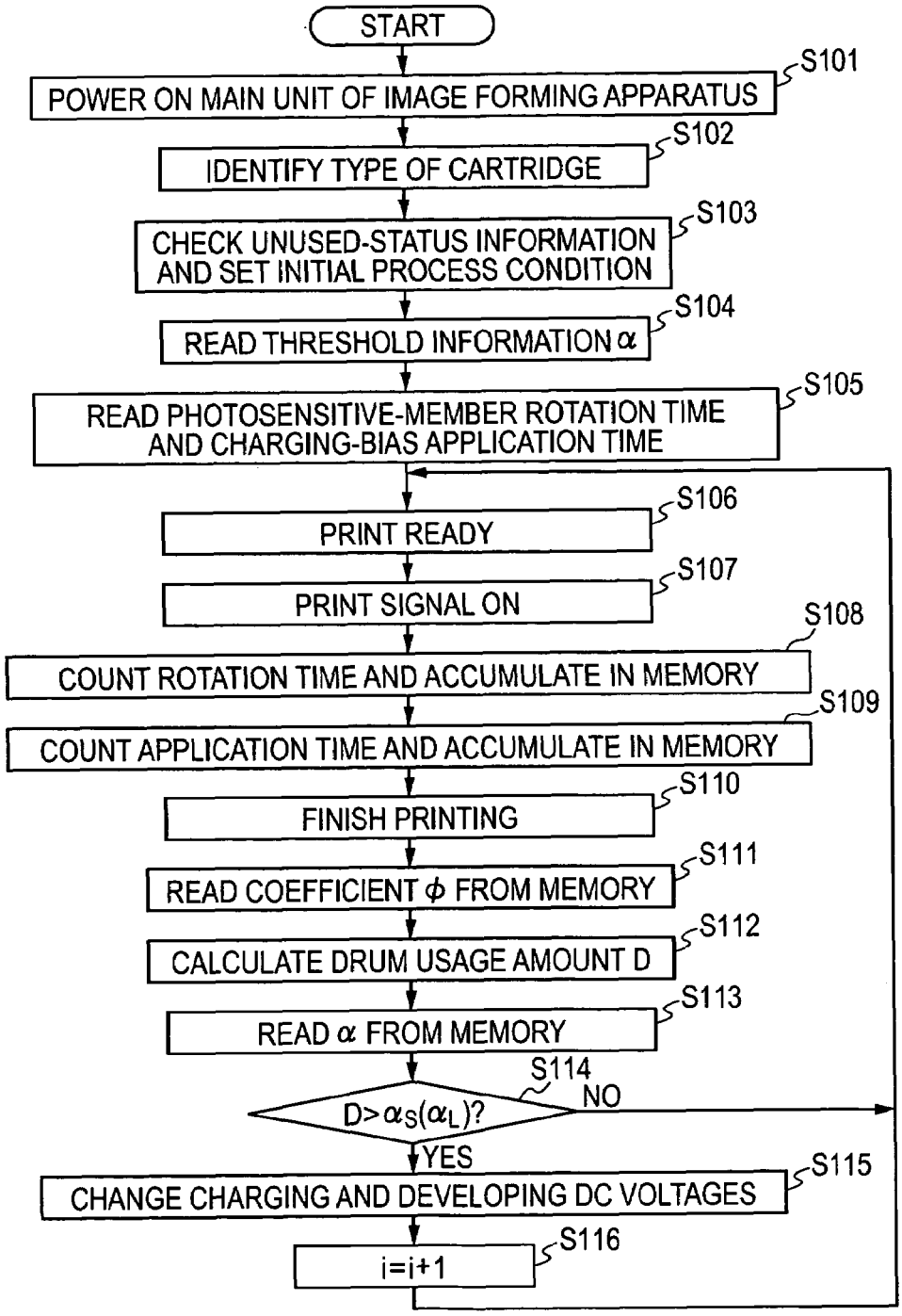
FIG. 10 is a flowchart of a process controlling operation in the first example.

The image forming operation in this embodiment is controlled similarly to the control according to the flowchart in FIG. 10 for the first example, so that description thereof will be omitted.

The construction of the cartridge C in FIG. 17 has been described earlier, so that description thereof will be omitted.

In the first and second examples, as shown in FIGS. 16 and 17, the photosensitive-drum rotation-time information and the charging-bias application-time information are separately updated and stored. However, without limitation thereto, instead of separately storing the photosensitive-drum rotation-time information and the charging-bias application-time information, similar advantages can be achieved by updating and storing information (D) regarding the amount of usage of the photosensitive member, calculated using the photosensitive-drum rotation-time information and the charging-bias application-time information.

As described above, according to this embodiment, even when a plurality of types of cartridges having different photosensitive-layer thicknesses and different toner capacities is used in the main unit of the same image forming apparatus, variation in density and line width can be reduced. More specifically, by process control is exercised in different manners at the same timing based on the photosensitive-drum usage amount, variation in image quality due to the difference between the cartridge types, particularly variation in density and line width, can be reduced. Furthermore, stable image quality can be achieved over the lifespan of the cartridges from their initial use.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-264220 filed Sep. 10, 2004, and Japanese Application No. 2005-222899, filed Aug. 1, 2005, which are hereby incorporated by reference herein in its entirety.

What is claimed is:

1. An image forming apparatus having a plurality of types of cartridges detachably mountable thereto, each cartridge including an image carrier and a toner container used for image formation and a storage medium storing information, the cartridges being different from each other in a characteristic of the image carrier and a toner amount of the toner container, the image forming apparatus comprising:

a storage unit storing a plurality of setting values used for setting an image forming condition in accordance with characteristics of the cartridges; and a controller setting the image forming condition by selectively using the setting values based on information regarding a usage amount of each cartridge;

wherein the storage medium stores selection information for selecting the setting values corresponding to the characteristic of the image carrier and the toner amount of the toner container, and the controller selects the setting values with the selection information.

2. The image forming apparatus according to claim 1, wherein the storage medium stores threshold information regarding the usage amount of the image carrier, and wherein the controller sets the image forming condition based on the selection information, the threshold information, and the information regarding the usage amount of each cartridge.

3. The image forming apparatus according to claim 2, wherein each of the cartridges includes a charging member configured to charge the image carrier, and wherein the threshold information includes one of a rotation time of the image carrier and a bias application time for the charging member.

4. The image forming apparatus according to claim 1, wherein each of the cartridges includes a charging member configured to charge the image carrier and a developing member configured to develop a latent image formed on the image carrier, and wherein the pieces of setting information includes information regarding one of a bias that is applied to one of the charging member and the developing member, and information regarding an amount of exposure of the image carrier.

5. The image forming apparatus according to claim 1, wherein the storage medium stores calculation coefficient information, and wherein the controller calculates the usage amount of the cartridge using the calculation coefficient information.

6. The image forming apparatus according to claim 1, wherein the characteristic of the image carrier is a thickness of a photosensitive layer of the image carrier.

7. A cartridge detachably mountable to an image forming apparatus, the cartridge comprising:

an image carrier;

a toner container that contains a toner;

a plurality of process members that acts on the image carrier; and a storage medium including a storage area storing selection information for selecting setting values corresponding to a characteristic of the image carrier and a toner amount of the toner container, the setting values being selectively used by a controller of the image forming apparatus to set an imaging condition.

8. The cartridge according to claim 7, wherein the storage medium includes a storage area storing threshold information regarding a usage amount of the cartridge.

9. The cartridge according to claim 8, wherein the process members include a charging member configured to charge the image carrier, and wherein the threshold information regarding the usage amount of the image carrier includes one of a rotation time of the image carrier and a bias application time for the charging member.

10. The cartridge according to claim 7, wherein the process members include a charging member configured to charge the image carrier and a developing member configured to develop a latent image formed on the image carrier, and wherein the pieces of setting information include one of information regarding a bias that is applied to one of the charging member and the developing member, and information regarding an amount of exposure of the image carrier.

11. The cartridge according to claim 7, wherein the storage medium includes a storage area storing calculation coefficient information for calculating a usage amount of the image carrier.

12. The cartridge according to claim 7, wherein the characteristic of the image carrier is a thickness of a photosensitive layer of the image carrier.

13. A storage medium that is mounted on a cartridge used in an image forming apparatus, the cartridge including an image carrier, a toner container that contains a toner and a plurality of process members that acts on the image carrier, the storage medium comprising:

a storage area storing selection information for selecting setting values corresponding to a characteristic of the image carrier and a toner amount of the toner container, the setting values being selectively used by a controller of the image forming apparatus to set an imaging condition.

14. The storage medium according to claim 13, further comprising a storage area storing threshold information regarding a usage amount of the image carrier.

15. The storage medium according to claim 14, wherein the process members include a charging member configured to charge the image carrier, and wherein the threshold information regarding the usage amount of the image carrier includes one of a rotation time of the image carrier and a bias application time for the charging member.

16. The storage medium according to claim 13, further comprising a storage area storing calculation coefficient information for calculating a usage amount of the image carrier.

17. An image forming apparatus having a plurality of types of cartridges detachably mountable thereto, each cartridge including an image carrier and a toner container that contains a toner used for image formation, the cartridges being different from each other in a first characteristic of the image carrier and a second characteristic the toner the image forming apparatus comprising:

a storage unit that stores a plurality of setting values in accordance with characteristics of the cartridges; and a controller that sets an image forming condition by selectively using the setting values stored in the storage unit, wherein the storage unit stores selection information for selecting the setting values corresponding to the first characteristic and the second characteristic, and the controller selects the setting values with the selection information.

18. The image forming apparatus according to claim 17, wherein the second characteristic is a toner amount of the toner container.

19. The image forming apparatus according to claim 18, wherein the first characteristic is a thickness of a photosensitive layer of the image carrier.

* * * * *